United States Patent [19]

Ball

[11] Patent Number: 4,459,778

[45] Date of Patent: Jul. 17, 1984

[54] ADJUSTING DEVICE FOR A SLAT BLIND CONTAINED IN A SEALED DOUBLE GLAZED WINDOW

[76] Inventor: James Ball, 14256 Green Crest Dr., White Rock, British Columbia, Canada, V4A 2Y6

[21] Appl. No.: 453,271

[22] Filed: Dec. 27, 1982

[51] Int. Cl.[3] ..... E06B 7/08

[52] U.S. Cl. ..... 49/64; 49/355; 160/107

[58] Field of Search ..... 49/64, 354, 355, 356; 160/107, 168

[56] References Cited

U.S. PATENT DOCUMENTS

| | | | |
|---|---|---|---|
| 182,992 | 10/1876 | Byam | 49/64 |
| 2,179,763 | 11/1939 | Smolowitz . | |
| 2,490,295 | 12/1949 | Fisher . | |
| 2,631,339 | 3/1953 | Pratt | 49/64 |
| 3,201,832 | 8/1965 | Hordis et al. . | |
| 3,443,624 | 5/1969 | Toth | 160/107 |
| 3,719,221 | 3/1973 | Hanson | 160/168 |
| 4,274,469 | 6/1981 | Kuyper et al. | 160/107 |

*Primary Examiner*—Kenneth Downey
*Attorney, Agent, or Firm*—Ridout & Maybee

[57] ABSTRACT

A sealed double glazed window comprises two spaced panes of glass sealed in a frame and a slat blind positioned in the space between the panes having control means for adjusting the slats. The inner pane of glass has a hole therethrough for providing access to the control means of the slat blind. An adjusting device is mounted about the hole so that the slats of the blind may be adjusted while maintaining the window seal. The adjusting device has a flexible diaphragm sealed about the hole and has adjusting means passing through the hole from the diaphragm to the control means thereby maintaining the hermetic seal of the window unit.

6 Claims, 4 Drawing Figures

ADJUSTING DEVICE FOR A SLAT BLIND CONTAINED IN A SEALED DOUBLE GLAZED WINDOW

The present invention relates to a sealed double glazed window having a slat blind positioned between the panes of glass, and an adjusting device mounted on one of the panes and sealed thereto for adjusting the slats of the blind while maintaining the window seal.

Several prior devices are known for adjusting a slat blind sealed in a double glazed window. U.S. Pat. No. 2,490,295 issued Dec. 6, 1949 to E. G. Fisher describes an adjusting device mounted on one of the panes of glass and being sealed by means of a sealing ring about an adjusting shaft inserted through the glass. U.S. Pat. No. 3,201,832 issued Aug. 24, 1965 to V. A. Hordis et al. describes an adjusting device for a blind in a sealed window which employs magnets to move the control mechanism of the blind for adjustment of the slats.

Neither of these prior devices is acceptably reliable when subjected to repeated use over a number of years. Leakage is inherent over time in a device such as described in Fisher which incorporates direct control of the blind through the adjusting device, while the device described in Hordis et al suffers from the inherent mechanical disadvantages of indirect control of the blind mechanism. More complicated devices are also known, but none afford the advantages of the present device which allows for direct mechanical interaction with the control mechanism of the blind as well as providing for a reliable means of maintaining the window seal during years of repeated use.

Accordingly, the present invention provides a sealed double glazed window comprising: two spaced panes of glass sealed in a frame; a slat blind positioned in the space between the panes, said blind having control means for adjusting the slats; one pane of glass having an aperture therethrough for providing access to the control means; and an adjusting device mounted about the aperture so that the slats may be adjusted while maintaining the window seal, said device having a flexible diaphragm sealed about the aperture and having adjusting means passing through the aperture from the diaphragm to the control means.

A preferred embodiment of the invention is hereafter described with reference to the figures in which.

Figure 1:
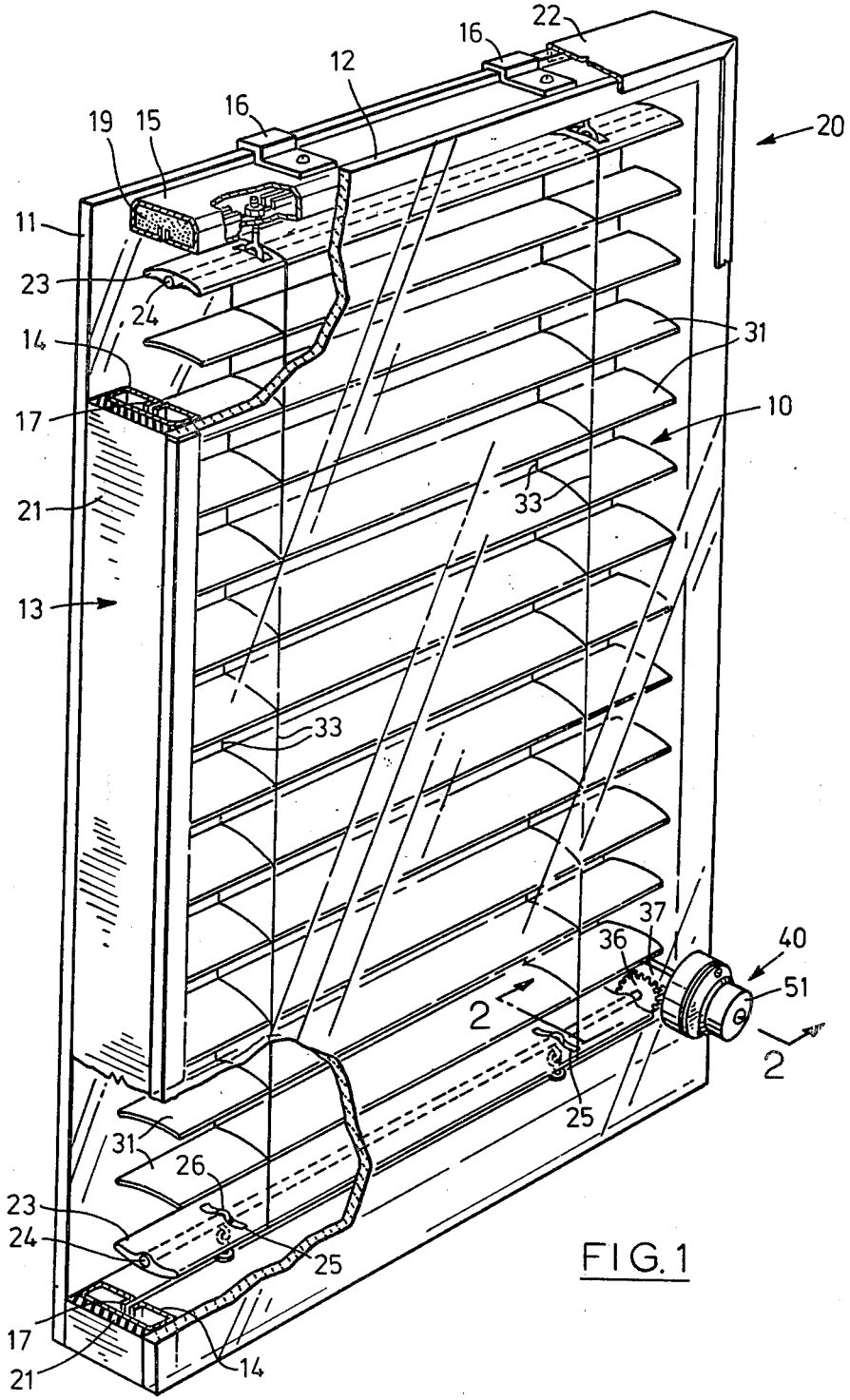
FIG. 1 is a plan view of a window of the present invention.

A slat blind 10 is positioned betweem two panes of glass 11 and 12 which are spaced apart by a frame 13 comprising two vertical side members 14, and top and bottom members 15. The frame members 14 and 15 comprise rolled aluminum sections having the longitudinal edges 17 thereof curved inward and butted together to form a longitudinal seam 18. A dessicant 19 such as silica gel may be added to any or all of the frame members 14 and 15 for the purpose of drying the air within the sealed window unit 20. The seams 18 in the frame members 14 and 15 allow the air within the window unit 20 to interact with the dessicant 19.

Window unit 20 is assembled by anchoring and tensioning the blind 10 in the top and bottom frame members 15 which are held in position by temporary clips 16. A sealant 21 is used to hermetically seal the panes of glass 11 and 12 about the four frame members. After removal of the clips 16 and application of additional sealant 21 level with the edges of the panes of glass 11 and 12, a protective metal covering 22 may be applied about the periphery of the unit 20.

Figure 2:
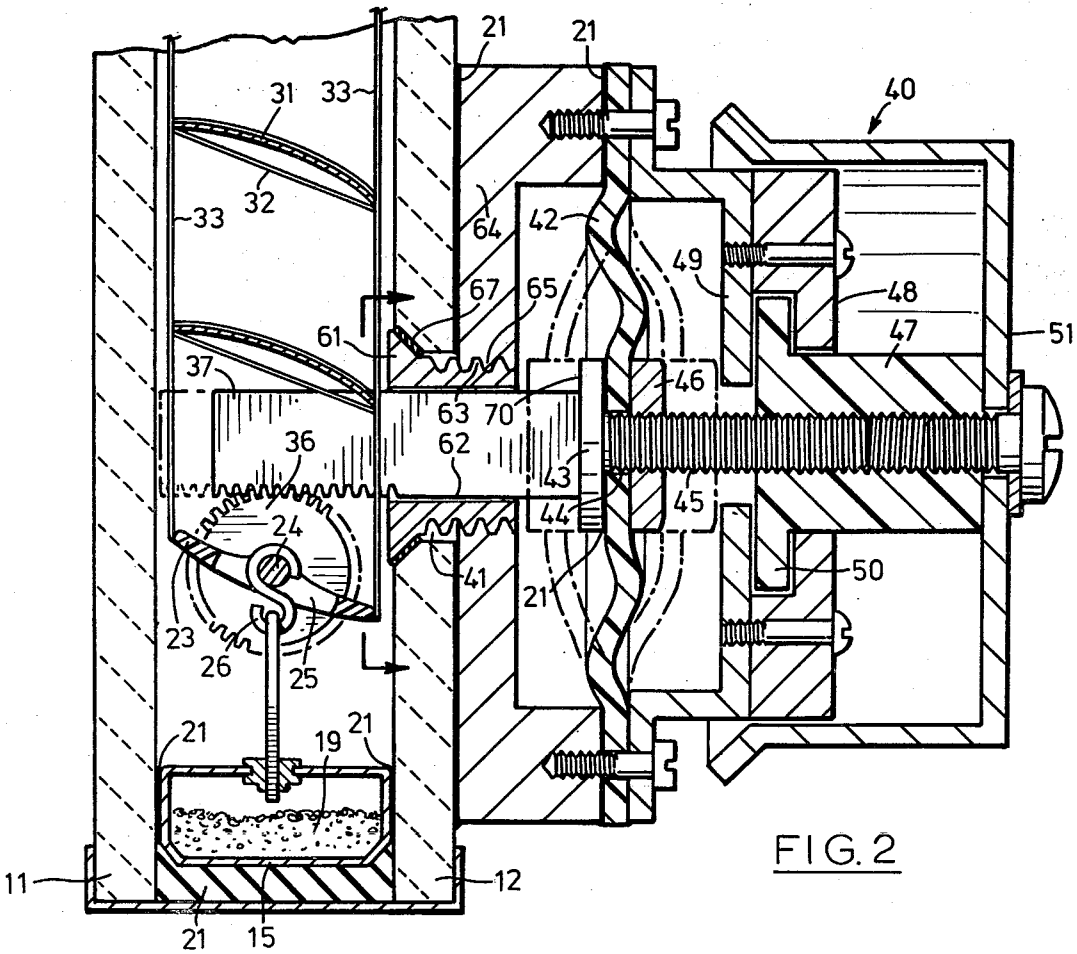
FIG. 2 is a cross sectional view of an adjusting device of the invention as mounted on a window pane.

The blind 10 is anchored within the window unit 20 in a conventional manner. As shown in FIGS. 1 and 2, the blind 10 has stiffened slats 23 at either end thereof. A rod 24 is embedded longitudinally along the axis of rotation of each slat 23. Cut away portions 25 are provided at the suspension points of each slat 23 exposing the rod 24. Hooks 26 are used to engage the rods 24 at the cut away portions 25 to provide means for anchoring the blind 10 to the frame members 15.

The blind 10 is of conventional construction wherein thin slats 31 are spaced from one another on ladders 32 which are made of string or fabric. The ends of the ladders 32 are secured to the stiffened slats 23 so that rotation of the slats 23 about the longitudinal axis of each rod 24 causes the vertical elements 33 of the ladders 32 to move oppositely one another and thus, causes the thin slats 31 to also rotate about their longitudinal axes. A control means is associated with one of the stiffened slats 23. A preferred control means comprises a control disc 36 mounted on the rod 24, wherein the disc 36 is a gear or pinion which cooperates with a rack 37 to effect rotation of slat 23 and hence, adjustment of the thin slats 31.

Movement of the disc or pinion 36 is controlled from the exterior of the window unit 20 by the preferred adjusting device 40 of the invention, which is mounted and sealed about an aperture 41 in the inner window pane 12 (FIG. 2). The hermetic seal of the window unit 20 is maintained by a flexible or elastomeric diaphragm 42 in the adjusting device 40. An end 43 of the rack 37 protrudes through the aperture 41 and is attached to the diaphragm 42 by means of an adhesive sealant 21. Affixed to the end 43 through an opening 44 in the diaphragm 42 is the head of a bolt 45. The bolt 45 is secured in place by a nut 46 which also serves to compress and seal the diaphragm 42.

The bolt 45 is threaded partially into a flanged nut 47, which is held stationary relative to the longitudinal movement of the bolt 45 by means of structural elements 48 and 49. These elements 48 and 49 loosely confine the flanged portion 50 of the nut 47 while allowing for rotation of the nut 47 about the bolt 45. To facilitate rotation of the nut 47, an adjusting knob 51 is affixed to the end of the nut 47 opposite the bolt 45. Thus, with the device 40 mounted on the pane 12 and sealed thereto, the slats 31 of the blind 10 can be adjusted without disturbing the window seal by simply turning the adjusting knob 51 which causes the bolt 45 and the rack 37 to move longitudinally thereby rotating the pinion 36.

Figure 3:
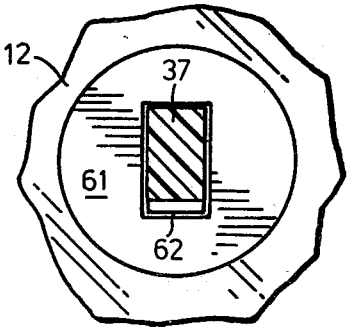
FIG. 3 is a cross sectional view of a detail of the adjusting means of the invention.

In translating the rotary motion of the knob 51 and the nut 47 into longitudinal motion of the bolt 45 and the rack 37, there is a certain amount of twisting force exerted by the bolt 45 at the area of attachment to the rack 37. To prevent this twisting force from effecting the smooth operation of the rack 37 and pinion 36, it is preferred to provide a plug 61 in the aperture 41 having a channel 62 therethrough which is shaped with at least two flat sides corresponding to sides of the rack 37 so that the rack 37 can slide smoothly through the channel 62 but is unable to twist (FIG. 3).

Another useful feature of the plug 61 can be seen in FIG. 2. By providing the plug 61 with a thread 63, it can be used to ensure a more secure mounting of the adjusting device 40 on the window pane 12. Thus, the face 64 of the device 40 may be provided with threaded opening 65 to allow the plug 61 to be threaded into the face 64 thereby providing in conjunction with adhesive sealant 21 a secure mounting of the device on the pane 12. Additionally it is desirable to have a resilient washer 67 positioned between the glass about the aperture 41 and the plug 61.

By providing the rack 37 with a flange 70 at the end 43 secured to the diaphragm 42 the plug 61 can act as a stop for the rack 37 by engaging the flange 70 when the rack 37 is moved toward the outer pane of glass 11. By proper design of the rack 37, the engagement of the flange 70 with the plug 61 will prevent accidental forcing of the rack 37 against the pane of glass 11 when manipulating the knob 51.

The foregoing description has related to a preferred embodiment of the present invention. Clearly, there are a number of alternate control means for adjusting a slat blind such as used here, and the adjusting device 40 may be positioned elsewhere on the window pane 12 in association with a control means attached to a stiffened slat 23.

Figure 4:
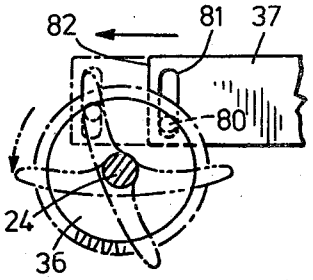
FIG. 4 is a side elevation showing a detail of an alternate embodiment of the control means of the blind.

Regarding alternative control means, FIG. 4 illustrates a Scotch yoke arrangement whereby the disc 36 has a pin 80 which slides up and down in a vertical slot 81 located toward the end 82 of the rack 37.

What I claim is:

1. A sealed double glazed window comprising:

two spaced panes of glass sealed in a frame;

a slat blind positioned in the space between the panes, said blind having control means for adjusting the slats;

one pane of glass having an aperture therethrough for providing access to the control means; and an adjusting device mounted about the aperture so that the slats may be adjusted while maintaining the window seal, said device having a flexible diaphragm sealed about the aperture and having adjusting means passing through the aperture from the diaphragm to the control means.

2. The window as claimed in claim 1, further comprising a threaded plug inserted in the aperture upon which plug the adjusting device is threaded to provide snug engagement of the device against the glass about the aperture, said plug having a hole therethrough to accommodate the adjusting means.

3. The window as claimed in claim 2, wherein the adjusting means comprises a member having at least two flat sides and the hole in the plug being shaped to provide a sliding fit for the member so that rotational movement of the member is restricted.

4. The window as claimed in claim 1, wherein the adjusting means and the control means comprise a rack and pinion arrangement.

5. A window as claimed in claim 1, further comprising actuating means for moving the adjusting means back and forth through the aperture.

6. A window as claimed in claim 5, wherein the actuating means comprises a nut positioned in the adjusting device and a bolt, the bolt being attached to the adjusting means at one end and threaded into the nut at the other end so that rotation of the nut causes longitudinal movement of the bolt.

* * * * *